United States Patent [19]

Persson

[11] Patent Number: 4,533,079

[45] Date of Patent: Aug. 6, 1985

[54] TRAY, PARTICULARLY FOR FOODSTUFFS

[75] Inventor: Karl R. Persson, Halmstad, Sweden

[73] Assignee: Sprinter System AB, Sweden

[21] Appl. No.: 503,156

[22] PCT Filed: Oct. 8, 1982

[86] PCT No.: PCT/SE82/00324

§ 371 Date: Jun. 7, 1983

§ 102(e) Date: Jun. 7, 1983

[87] PCT Pub. No.: WO83/01242

PCT Pub. Date: Apr. 14, 1983

[30] Foreign Application Priority Data

Oct. 9, 1981 [SE] Sweden ..... 8106004

[51] Int. Cl.[3] ..... B65D 5/24

[52] U.S. Cl. ..... 229/31 R; 229/37 E

[58] Field of Search ..... 229/31 R, 30, 32, 34 R, 229/37 E

[56] References Cited

U.S. PATENT DOCUMENTS

| | | | |
|---|---|---|---|
| 2,330,262 | 9/1943 | Biggs | 229/31 R |
| 2,434,756 | 1/1948 | Brooks | 229/37 E |
| 3,034,697 | 5/1962 | Frankenstein | 229/31 R |
| 3,178,093 | 4/1965 | Wasyluka | 229/37 E |
| 4,199,097 | 4/1980 | Christensson | 229/31 R |
| 4,260,098 | 4/1981 | Manizza et al. | 229/31 R |
| 4,343,428 | 8/1982 | Persson | 229/31 R |

*Primary Examiner*—Joseph Man-Fu Moy

*Attorney, Agent, or Firm*—Ostrolenk, Faber, Gerb & Soffen

[57] ABSTRACT

The inventive tray includes a bottom (2) and four side walls (3–6), which have an extension in the form of a folded-out edge flange (11) in a plane parallel to the bottom (2) of the tray (1) and forming a continuous frame for coaction with a separate lid, sealable to the tray (1). At their upper portion (9) the side walls (3–6) are inclined inwards so that the continuous frame formed by the edge flange (11) is substantially within the outer contour of the side walls (3–6).

8 Claims, 8 Drawing Figures

TRAY, PARTICULARLY FOR FOODSTUFFS

The present invention relates to a tray, particularly for foodstuffs, said tray being produced from a stamped and creased blank made from carton or the like stiff material, said tray consisting of a bottom and four side walls, the latter being connected to each other in pairs by a corner structure consisting of at least two substantially triangular areas in contact with adjacent side walls having extensions in the form of folded-out flanges, which lie in a plane parallel to the bottom of the tray and form a continuous frame for coaction with a separate lid with which the tray may be closed.

Trays of this type are used for foodstuffs, and then often for ready-cooked food, which is usually warmed up directly in the tray, e.g. with the aid of a microwave oven or a hot air oven. In the known trays the side walls are provided with folded-out, outstanding edge flanges forming a frame against which a lid is intended to be fixed, e.g. by hot-melt sealing, after the tray has been filled. During the packing of these trays the outstanding edge flanges have caused quite a few problems. From the handling aspect, the flanges result in that the trays cannot be put on their side edges during packing, and that hooking together or flange collisions occur, with the result that there is tray leakage. Furthermore, the flanges take up space, since a gap corresponding to the flange width occurs between the trays when they are packed side by side.

The drawbacks of this known type of tray have been eliminated by the invention, which proposes the provision of a tray of the kind mentioned in the introduction, which can be stacked both side by side and on a side edge during packing without any outstanding flanges catching in each other or forming air gaps between the trays. Essentially distinguishing for the invention is that each of the side walls is inclined at an acute angle to the bottom plane of the tray in the area above a crease line extending round the periphery of the tray and at a given distance from the bottom plane thereof, so that the continuous frame formed by the edge flanges is substantially inside the outer contour of the side walls. There is accordingly provided a tray, which, in spite of its being provided with an edge flange running round its opening, for coaction with a lid tightly sealing the tray, does not have any parts projecting outside the contour of the side walls.

The invention will now be described below with reference to some embodiments illustrated by way of example on the appended drawings.

Figure 1:
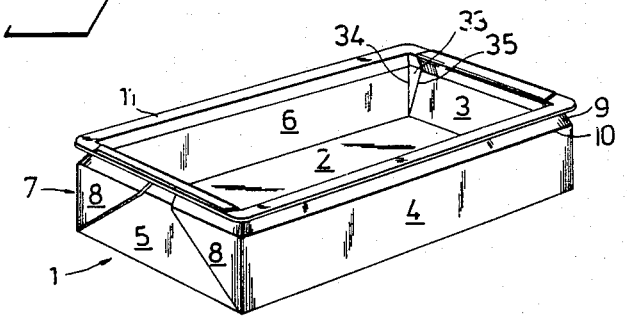
Figure 2:
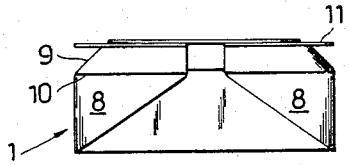
Figure 3:
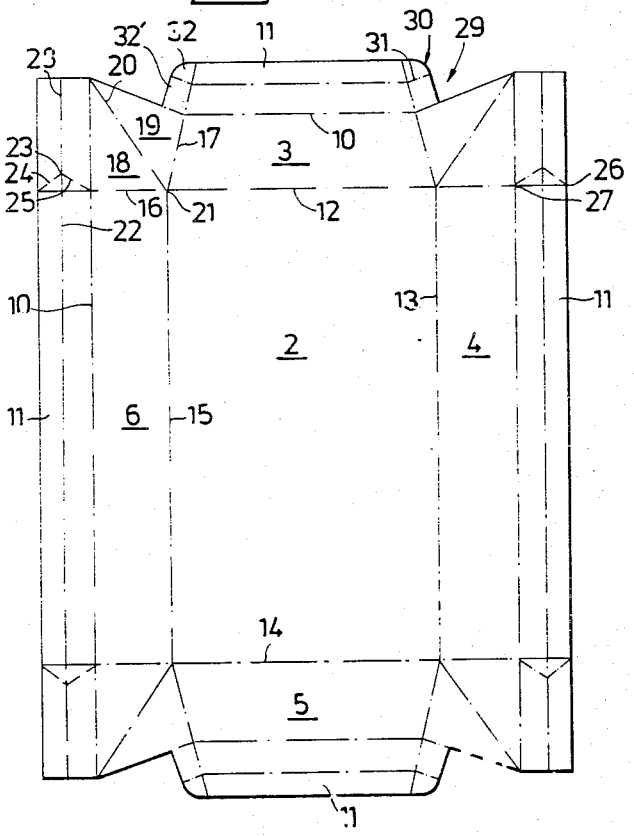
Figure 4:
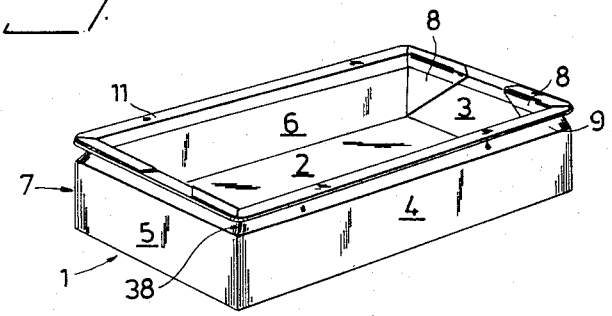
Figure 5:
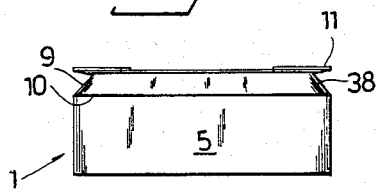
Figure 6:
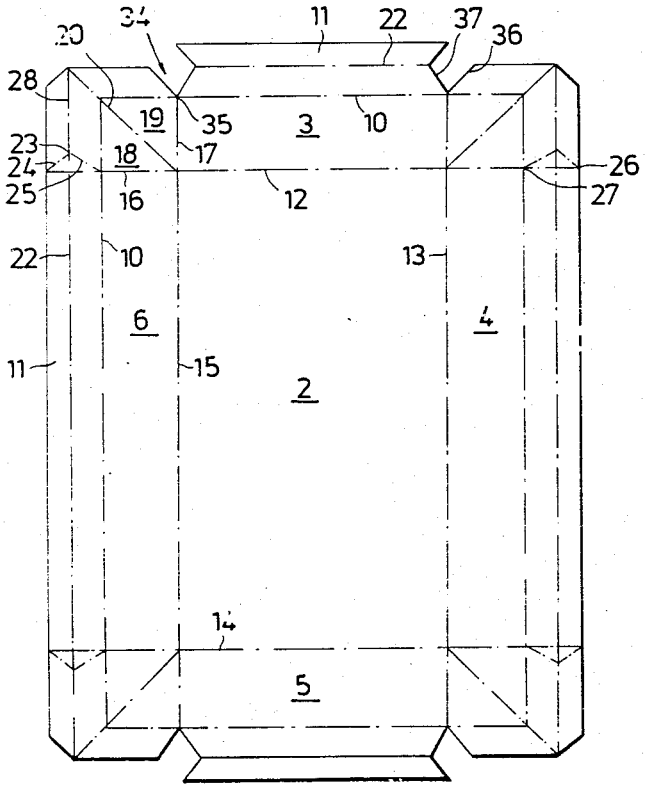
Figure 7:
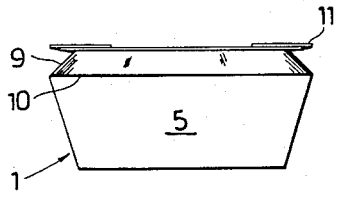
Figure 8:
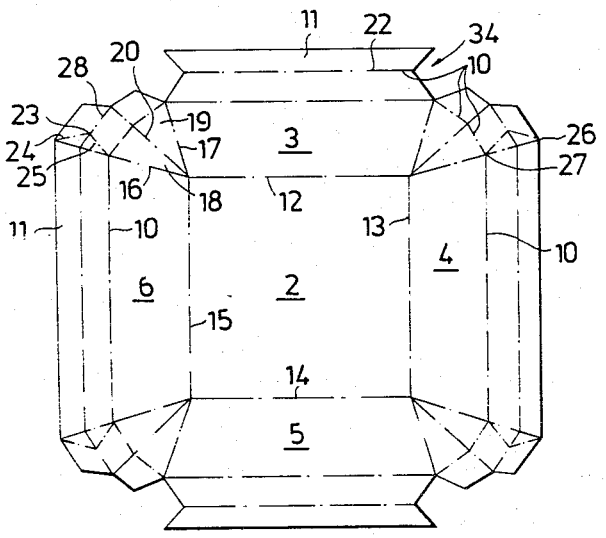

FIG. 1 is a perspective view of a first embodiment of a tray in accordance with the invention, FIG. 2 is an end view of the tray illustrated in FIG. 1, FIG. 3 is a plan view of the blank to the tray illustrated in FIGS. 1 and 2, FIG. 4 is a perspective view of a second embodiment of the tray in accordance with the invention, in which the fastening flaps are fixed to the inside of the short side walls, FIG. 5 is an end view of the tray illustrated in FIG. 4, FIG. 6 is a plan view of the blank to the tray illustrated in FIGS. 4 and 5, FIG. 7 is a side view of a third embodiment of the tray in accordance with the invention and FIG. 8 is a plan view of the blank to the tray illustrated in FIG. 7.

The tray 1 illustrated on the drawings is preferably manufactured from carton or the like stiff material, having at least on the side facing towards its interior a liquid-proof, sealable, high temperature-resistant coating such as polyester. The tray 1 has a bottom 2 and four side walls 3, 4, 5, 6 connected in pairs to each other by a corner structure 7 including a fastening flap 8, which is either attached to the outside or inside of the adjacent side wall. The side walls 3, 4, 5, 6 have an upper portion 9 inclining at an acute angle to the bottom 2 of the tray 1 from a crease line 10 round the tray 1. The side walls 3, 4, 5, 6 have an extension in the form of an edge flange 11, folded out in a plane parallel to the bottom of the tray 1 from the upper inclined portion 9, and forming a frame running round the opening of the tray 1 for coaction with a separate lid which is sealable against the tray 1, although this lid is not shown on the drawing. The upper side wall portion 9 forms an angle to the bottom 2 and extends upwards a distance there from such that the continuous frame formed by the edge flange 11 is inside the outer contour of the side walls 3, 4, 5, 6.

With the aid of crease lines 12, 13, 14, 15 the blank depicted on the drawings is divided into a bottom 2 and four side walls 3, 4, 5, 6. The ends of the sides merge into a corner structure or portion 7 which forms two triangular corner areas 18, 19 with the aid of two outer crease lines 16, 17, the two triangular areas being divided by a crease line 20. All these corner crease lines 16, 17, 20 start from the respective corner 21 of the bottom 2. An extension running substantially round the whole of the periphery of the blank forms the edge flange 11 when the blank is erected. This edge flange 11 is defined by an edge crease line 22, between which and the crease lines 12–15 there extends a crease line 10 substantially round the whole of the blank at a predetermined distance from the bottom crease lines 12–15. At its free outer end one of the two outer corner crease lines 16, 17 has two converging crease lines 24, 25 which meet each other at a point 23 situated on the edge crease line 22. The outer crease line 24 starts from the end 26 of the corner crease line 16 at the periphery of the edge flange 11, and the other crease line 25 starts from the intersection point 27 of the corner crease line 16 with the crease line 10. These crease lines 24, 25 are preferably situated on one of the triangular areas 18 or 19 forming the corner portions 7. It is possible, however, to extend the crease lines 24, 25 on the outer portions of the side walls outside the crease line 10. Either of the corner areas 18 or 19 in the corner portion 7 has an extension in the form of an edge flange, similar to the side walls, which may be folded out along an edge crease line 28 when the blank is erected, and constitutes an extension of the edge crease line 22 of the adjacent side wall.

The blank illustrated in FIG. 3 has a corner structure 7 in which the fastening flap 8 is intended to be attached to the outside of the side walls 3, 4 when the blank is erected, as will be seen from the erected blank 1 illustrated in FIGS. 1 and 2. Of the two outer corner crease lines 16, 17 defining the corner areas 18, 19 in this embodiment, one 16 of them forms a normal to the bottom crease line 13, 15 of the adjacent side wall 4, 6, while the other corner crease line forms an acute angle to the bottom crease line 12, 14 of the adjacent side wall 3, 5. The corner area 19 has a cutout 29 contiguous to the corner crease line 17 via a flap portion 30. The flap portion 30 is divided by a short crease line 31 into an inner 32' and an outer part 32. During a first operation in the erection of the blank illustrated in FIG. 3, the side walls 3, 6 are folded up, by an unillustrated forming tool including outer and inner erecting means, to a position in which the fastening flaps 8, achieved by double-folding of the areas 18, 19 along the crease line 20, are attached preferably by heating to the outside of the side walls 3, 5. In a second operation subsequent thereto, unillustrated outer and inner forming means move diagonally inwards, at least towards the corner portions 7 of the tray 1, for providing an inward positional displacement of the edge flange 11 and the upper portion 9 of the tray 1 round the side walls 3–6 of the tray 1 and parallel to the crease line 10 running round the bottom 2, simultaneously as the edge flanges 11 are folded out to a position parallel to the bottom 2, and the corner portion 7 under the edge flange 11 is rolled in and the excess material there compressed into the space 33 arranged in the corner portions. This space 33 occurs in this embodiment between the corners 34 of the erected blank and a crease band 35 formed by the corner crease line 17. Pressing-in of the corner portion 7, whereat the sloping upper portion 9 is formed, is facilitated by the presence of the crease lines 24 and 25 extending over the upper portion 9 and the edge flange 11. During the first erection operation, the tray blank can be supplied with sufficient heat so that forming during the second operation can be carried out with a cold tool. The tray corners will be extremely well sealed by the presence of the flap portion 30, through with the aid of which the plastics coated side of the blank is in contact (plastics to plastics) from the bottom corner 21 right out to the periphery of the edge flange 11 after the blank has been erected. Direct contact between two edge flange layers situated one on top of the other is provided by the cutout 29, except at the outer portion 32 of the flap portion 30.

The blank illustrated in FIG. 6 has a corner structure 7, in which the fastening flap 8 is intended for attachment to the inside of the side walls 3, 5 when the blank is erected. This may be suitable from the decoration aspect, for example. A tray 1 manufactured from the blank illustrated in FIG. 6 is shown in FIGS. 4 and 5. In this embodiment both corner crease lines 16, 17 form a right angle to the bottom crease line of the contiguous side wall. Similar to the first embodiment described above, the corner area 18 is provided with an edge flange and both crease lines 24, 25, while the other corner area 19 is provided with a triangular cutout 34. This cutout 34 has one of its corners at the meeting point 35 of the corner crease line 17 and the crease line 10, and has its side edges 36, 37 extending to the outer edge of the corner area 19, said outer edge being defined by an imaginary linear extension of the edge crease line 22 of the contiguous side wall 3, 5. Erection of the blank illustrated in FIG. 6 is accomplished in the same way as that for the embodiment described above and illustrated in FIGS. 1–3, except for the folding of the fastening flaps 8, these flaps being attached to the inside of the tray side walls 3, 5 for the blank illustrated in FIG. 6. When the blank is erected, the cutout 34 provides a space 38 below the edge crease line 22 to enable pressing in the corner portion 7 under the edge flange 11.

The blank shown in FIG. 8 has a corner structure 7 in which the fastening flap is intended to be attached to the inside of the side walls 3, 5, similar to the case with the embodiment illustrated in FIGS. 4–6. The corner structure 7 for the embodiment using the blank illustrated in FIG. 8 is however designed so that the erected blank forms a tray 1 with conical side walls 3–6 i.e. these form an obtuse angle to the bottom 2 of the tray 1. This tray variant makes the contents of the tray 1 easily available, in spite of waisting the upper portion of the tray. The difference between this embodiment and the one illustrated in FIGS. 4–6 is only that the outer corner crease lines 16, 17 form an angle which is greater than 90° to the bottom crease lines 12–15 of the contiguous side walls 3–6, and that the crease lines 10, 28 on the corner areas 18, 19 must have a somewhat different extension, although the corner crease line 20, will be the same, as a result of the inclination of the crease lines 16, 17, when the blank is in a flat condition, for these crease lines 10, 28 to coincide with the side wall crease lines 10, 22 when the blank is erected.

I claim:

1. A tray produced from a stamped and creased blank made from carton or the like stiff material, said tray (1) consisting of a bottom (2) and four side walls (3–6), the latter being connected in pairs to each other by a corner structure (7) consisting of at least two substantially triangular areas (18, 19) in contact with adjacent side walls (3–6) having extensions in the form of folded-out flanges (11), lying in a plane parallel to the bottom (2) of the tray (1) and forming a continuous frame, for coaction with a separate lid with which the tray may be closed, characterized in that each of the side walls (3–6) consists of a lower and an upper wall portion, the former being folded up along a crease line (12–15) defining a bottom (2) such that it is substantially perpendicular to the bottom plane of the tray (1) and has a height from the bottom (2) attaining to at least half the tray height, said lower wall portion merging into the upper wall portion along a crease line (10) extending round the periphery of the tray (1) at a predetermined distance from the bottom crease line (12–15), said upper wall portion inclining at an acute angle to the bottom plane of the tray (1) and extending towards the interior of the tray (1) a distance substantially corresponding to the width of the continuous frame formed by the edge flanges (11), said frame being situated substantially within the outer contour of the bottom (2).

2. Blank for a tray (1) having a bottom (2) and side walls folded up along creased lines (12–15) defining said bottom (2), said side walls being inclined at an acute angle to the bottom of the tray (3–6) being provided at their upper edges with outwardly folded edge flanges (11) forming a continuous frame, said continuous frame lying substantially within the outer contours of said side walls, at each corner portion (7) the blank having three corner crease lines (16, 17, 20) starting from the respective bottom corner (21) and defining two substantially equal and triangular areas (18, 19), for double folding along their mutual crease line (20) to form a substantially triangular double-walled fastening flap (8) intended for attaching to one of the adjacent side walls (3, 5), subsequent to which the edge flanges (11) may be folded out along edge crease lines (22), and a crease line (10) is situated between the bottom crease lines (12–15) and the edge crease lines (22), and extends along the side walls (3–6) at a predetermined distance from, and parallel to, the bottom crease lines (12–15) substantially round the whole blank.

3. Blank as claimed in claim 2, characterized in that there are two converging crease lines (24, 25) for facilitating pressing in the corner portion (7) under the edge flange (11) and folding out the edge flange (11) when the blank is erected, one of said lines (24) starting from the termination point of the crease line (16) at the outer edge of said flange (11) and meeting the line (25) at the crease line (28), wherefrom the line (25) extends, to terminate at the intersection of crease lines (16 and 10).

4. Blank as claimed in claim 3, characterized in that the crease lines (24, 25) are situated on one of the triangular areas (18, 19) of the corner portions, said area (18) including an edge flange constituting a continuation of the edge flange (11) of the contiguous side wall, said extension being defined by the outer corner crease line (16) and edge crease line (28).

5. Blank as claimed in claim 3, characterized in that one (16) of both outer corner crease lines (16, 17) forms a normal to the bottom crease line (13, 15) of the contiguous side wall (4, 6) and that the other (17) outer corner crease line forms an acute angle to the bottom crease line (12, 14) of the contiguous side wall (3, 5), whereby a space (33) at the upper portion of the corner structure (7) occurs after attaching the fastening flap (8) to the outside of said side wall (3, 5) between the corner (34) of the erected blank and the crease bead (35) formed by the other outer corner crease line (17) to allow the inward urging of the edge flange (11) and pressing in the corner portion (7) under the edge flange (11).

6. Blank as claimed in claim 5, characterized in that the corner area (19) defined by the crease line (20) and the other, outer corner crease line (17) has a cutout (29) at its outer edge contiguous to said corner crease line (17) via a flap portion (30), direct contact between two edge flange layers situated one on top of the other being obtained after the blank has been erected, excepting at a portion (32) of the flap portion (30) at the free end of the outer corner crease line (17).

7. Blank as claimed in any of the preceding claims, characterized in that one outer corner crease line (17) in the respective corner structure terminates at the intersection point (35) with a crease line (10) situated between the bottom crease line (12–15) and the edge crease line (22), from said intersection point (35) there beginning a triangular cutout (34) with its apex situated in said intersection point (35) and its side edges (36, 37) extending to the periphery of the corner area (19), whereby a space (38) is created below the edge crease line (22) when the blank is erected, for enabling pressing the corner portion (7) under the edge flange (11).

8. Blank as claimed in any of the claims 1–6, characterized in that the outer corner crease lines (16, 17) form an acute angle to the bottom crease line (12–15) of contiguous side walls (3–6), whereby the side walls mutually diverge from the bottom (2) of the tray (1) after the blank is erected.

* * * * *